US005318229A

United States Patent [19]

Brown

[11] Patent Number: 5,318,229

[45] Date of Patent: Jun. 7, 1994

[54] PROTECTIVE DEVICE FOR PAPER SHREDDERS

[76] Inventor: John D. Brown, 812 New Mark Esplanade, Rockville, Md. 20850

[21] Appl. No.: 978,337

[22] Filed: Nov. 18, 1992

[51] Int. Cl.[5] ..... B02C 25/00

[52] U.S. Cl. ..... 241/34; 241/37.5; 241/236; 241/36

[58] Field of Search ..... 241/36, 375, 236, 46.015, 241/46.016, 34

[56] References Cited

U.S. PATENT DOCUMENTS 2,179,240 11/1939 Breitenstein .
4,018,392 4/1977 Wagner .
4,354,178 10/1982 Janssen .
4,426,044 1/1984 Butler .
4,815,669 3/1989 Fujii ..... 241/236 X
4,817,877 4/1989 Itoh et al. ..... 241/236 X
4,867,383 9/1989 Terry et al. ..... 241/24 X
5,188,301 2/1993 Hasegawa ..... 241/236 X

FOREIGN PATENT DOCUMENTS 3624996 2/1988 Fed. Rep. of Germany ..... 241/37.5

*Primary Examiner*—Mark Rosenbaum
*Assistant Examiner*—Frances Han
*Attorney, Agent, or Firm*—William D. Hall

[57] ABSTRACT

A paper shredder has cutting discs that are protected by detecting the approach of a metal object. When the object is detected, the motor that drives the discs is deenergized and a brake is applied to stop the cutting discs.

18 Claims, 1 Drawing Sheet

PROTECTIVE DEVICE FOR PAPER SHREDDERS

BACKGROUND OF THE INVENTION

This invention relates to paper shredders and provides a device for protecting the paper cutters of the shredder from damage.

Prior art paper shredders have a chute for guiding the paper to be shredded between two sets of cutting blades. In one type of shredding machine each set of cutting blades comprises a large number of thin discs on a common shaft. The discs are very small and the peripheries of the discs are the cutting blades. More details of two such machines are shown in U.S. Pat. No. 4,426,044 to Butler granted Jan. 17, 1984, and entitled "Document Shredding Machines," and U.S. Pat. No. 4,018,392 granted to Wagner on Apr. 19, 1977 and entitled "Shredding Machines."

When the paper that is fed into the cutting blades has a metal element such as a paper clip or staple, the delicate cutting blades of the shredder are damaged and must be replaced. The cost of such a repair usually runs to about $1300.

U.S. Pat. No. 4,354,178 teaches a metal detector for detecting small metal objects in wool before the wool enters a carding machine.

SUMMARY OF THE INVENTION

The invention may come in two forms. One form is an attachment for an existing shredder and the other form is a device built into new shredders.

In both of these forms a plastic or other non-metallic chute has a metal detector near its input end and feeds the paper, reaching its output end, into the cutting blades of the paper shredder. In such an arrangement I provide means for stopping the paper before the metal object reaches the cutting blades. One such arrangement stops the motor of the shredder when a metal object is detected by the metal detector.

In the form of the invention in which my protective device is built into newly manufactured paper shredders, a brake is applied to the rotating parts of the shredder to stop the cutting blades as soon as possible after a metal object is detected.

In its broadest aspects the invention resides in preventing a metal object, that has been detected, from reaching the cutting discs. Since it is the rotation of the cutting discs that moves the paper through the cutting discs, immediately stopping the motor is one way, indeed the preferred way, of solving the problem.

Other ways of solving the problem are broadly classified as (a) stopping the forward motion of the paper, and (b) diverting the paper path away from the cutter discs, in response to the detection of a metal object.

DETAILED DESCRIPTION OF THE INVENTION

Figure 1:
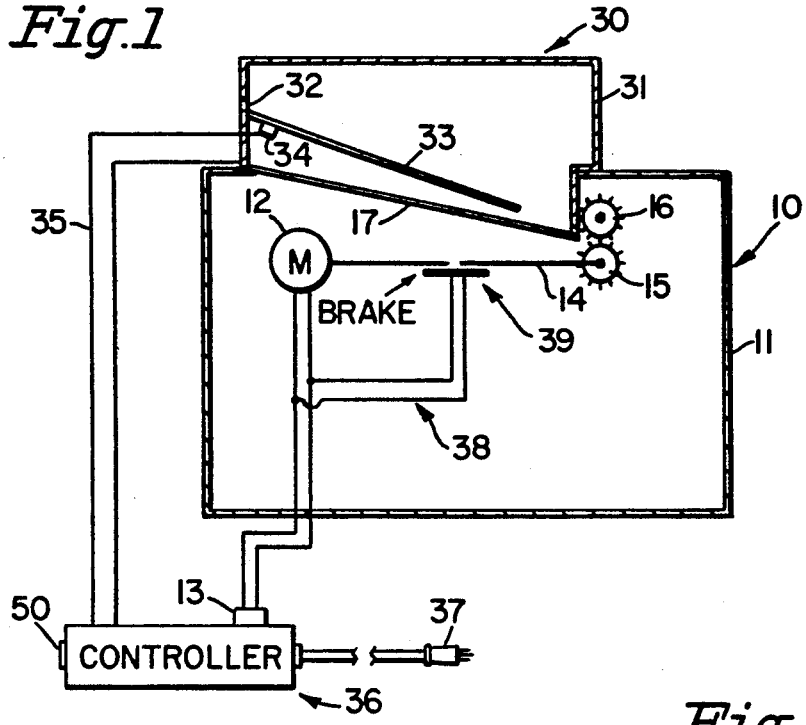
FIG. 1 is a schematic diagram of a paper shredder embodying the invention.
Figure 2:
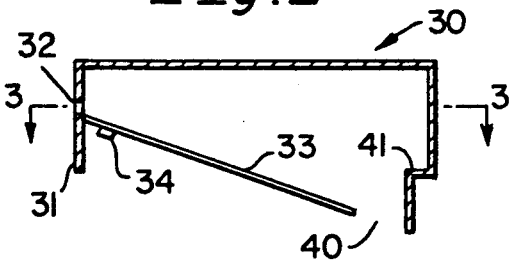
FIG. 2 shows an attachment to be added to an existing prior art paper shredder.

In FIG. 1, parts 10–17 are components of an existing prior art paper shredding machine. Such a machine 10 has a casing 11 supporting an electric motor 12 that is energized by wires terminating in a conventional electric plug 13 of the type adapted to plug into a conventional electric socket or outlet to thus provide 120 volts 60 Hz alternating current to the motor 12. The motor shaft 14 drives prior art cutting discs 15, 16 that shred the paper. Suitable cutting discs are more fully disclosed in said U.S. Pat. Nos. 4,426,044 and 4,018,392. Paper is fed along chute 17 to the cutting discs and is thereby shredded. Chute 17 may be metallic.

When the prior art paper shredder 10–17 is modified to embody my invention, an auxiliary plastic casing 30 is added. This casing includes a frame 31 having an inlet opening 32, a plastic chute 33, and a metal detector 34. The metal detector is connected by cable 35 to controller 36 which has the usual electrical plug 37 that may be inserted in a wall socket to provide 120 volts, 60 Hz to the controller 36. The source of power that feeds plug 37 is connected (inside controller 36) to the motor 12, via plug 13. If, however, the metal detector 34 detects a metal object on the paper, fed along chute 33, the controller 36 is alerted, along cable 35, and deenergizes motor 12. The chute 33 is so long that the inherent frictional forces that tend to stop the motor 12 and the cutting discs 15, 16 will come into play and will stop the cutting discs 15, 16 before they are damaged. The motor 12 remains stopped until the red push button 50 is depressed.

When the invention is incorporated into newly manufactured or rebuilt machines a brake 39 controlled by cable 38 may be added to immediately stop the motor 12 and the cutting discs 15, 16 when the motor 12 is deenergized by the metal detector 34.

Brakes for stopping machines driven by electric motors are well known and need not be shown or described in detail. One form of such a brake has a brake shoe spaced from a wheel on the motor shaft. When the motor is energized, a solenoid holds the brake shoe away from its complementary wheel, but when the power to the solenoid is disconnected the brake shoe is drawn into engagement with the wheel on the motor shaft by a spring. A brake such as is just described may be employed in the machine shown in FIG. 1.

The metal detecting means 34 may be of the type that detects articles, made of iron, such as staples or paper clips. This form of detector detects the magnetic properties of articles made of iron, and is very well known. Such a detector normally embodies a coil that produces a magnetic field. Any modification of that field by the entry of an object made of iron is detected and used to control the output of the magnetic detector.

Another well known form of metal detecting means uses alternating current to produce a magnetic field. When a metal object enters the field eddy currents are induced in the object thus causing a change, in the voltage or current that produces the field, which is detected.

Patents which teach the above principles of metal detection include U.S. Pat. No. 4,354,178 to Jannsen and U.S. Pat. No. 2,179,240 granted Nov. 7, 1939.

When the paper shredder of FIG. 1 is turned on by pressing start button 50 the motor 12 and the brake 39 are energized to rotate the cutter blades 15, 16. If, however, the detector 34 is actuated by a paper clip or the like the circuit to the motor 12 and to the brake 39 is interrupted, stopping the motor 12 and applying the brake 39. Preferably, the design is such that friction stops the cutter blades 15, 16 before the metal object reaches the blades.

Preferably, the chute 33 should have sufficient inclination so that paper fed onto its input end will slide, unassisted and under the force of gravity to the paper shredding discs 15, 16. The length of the chute 33 should be sufficient to permit the cutting discs 15, 16 to stop before a metal object, that sets off the detector 34, will reach the cutting discs 15, 16.

Figure 6:
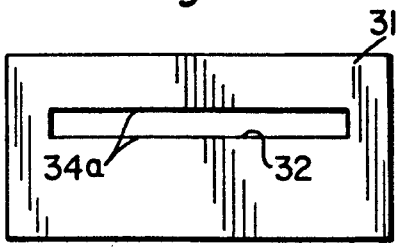
FIG. 6 illustrates a modified form of the invention in which the inlet opening 32 of the casing 31 is bounded by a metal detector 34*a*.

Instead of the metal detecting means 34 being mounted on the input end of chute 33, it may be of rectangular shape as shown at 34*a* of FIG. 6 and extends around the entrance opening 32 of the casing 31. This requires the paper to be inserted through the metal detector 34*a* in order to reach the chute 33.

In order to prevent persons from dropping paper vertically onto the chute 33 and thus avoiding the metal detector 34, the casing 31 has a roof.

Figure 4:
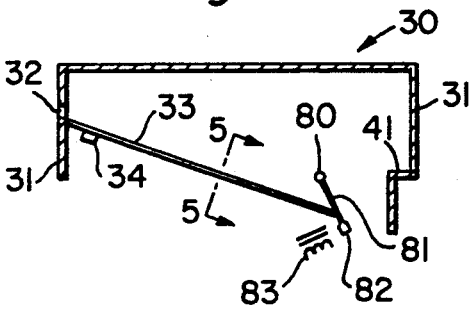
FIG. 4 is a side view of a modified form of attachment for a paper shredder.
Figure 3:
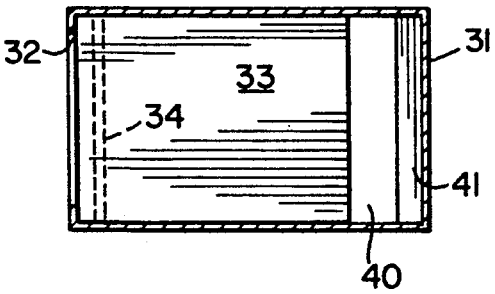
FIG. 3 is a sectional view taken along line 3—3 of FIG. 2.
Figure 5:
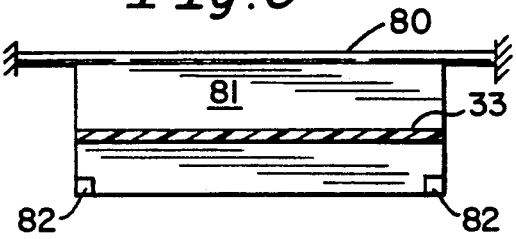
FIG. 5 is a sectional view taken along line 5—5 of of FIG. 4, but with the electromagnets omitted.

FIGS. 4 and 5 show a modified form of the invention. In FIG. 4, the components 30 to 34, 40 and 41 work in the manner described above. However, at the outlet end of the chute 33 there is a gate 81, mounted for rotation about shaft 80. While gravity normally holds gate 81 closed, its force against the outlet end of chute 33 is so small that the flow of paper down the chute 33 will open the gate 81 and allow the paper to pass to the cutting discs 15, 16 of the shredder. Alternatively, gate 81 may be heavy and normally held open by a spring. However, if a metal object is detected by detector 34 two solenoids 83 are energized and attract soft iron armatures 82 to press the gate 81 firmly against the free end of chute 33. This pinches and stops any paper that is in the gate and also stops any paper that thereafter arrives at the gate. The electrical circuitry may also shut down the motor of the shredder when the device of FIGS. 4 and 5 detects a metal object, but this is not necessary. If desired, a timer may be added to the circuit of the electromagnet 83 to hold the electromagnet energized for a time of sufficient for removing the metal object.

I claim to have invented:

1. A device for protecting a paper shredder from damage by a metal object that is associated with the paper, comprising:

feed means for feeding, to a shredder, paper to be shredded, metal detecting means associated with said feed means for detecting metal objects that are associated with the paper fed by said feed means to said shredder, said metal detecting means having spaced-apart portions forming an opening through which the paper may pass on its way to said feed means, and damage prevention means operated when said metal detecting means detects a metal object for preventing said metal object from damaging said shredder.

2. A device as defined in claim 1 including means for preventing the placing of paper onto said feed means other than between said portions.

3. A device as defined in claim 1 in which said opening is a slot.

4. A device as defined in claim 1 in which said damage prevention means comprises means for stopping said shredder before the metal object reaches the shredder.

5. A device as defined in claim 1 in which said damage prevention means comprises means for stopping said paper before the metal object reaches said shredder.

6. A device as defined in claim 5 in which said damage prevention means includes a gate which prevents the paper from passing the gate when a metal object is detected.

7. A device as defined in claim 1, comprising:

a brake for said shredder, means for normally holding said brake in an off position but applies the brake when said detecting means detects a metal object.

8. A device for protecting a paper shredder from damage by a metal object that is associated with the paper, comprising detecting means for detecting a metal object that is associated with the paper fed to a shredder, and means operable within a limited time period, in response to the detection of a metal object by said detecting means, for preventing the metal object from damaging said shredder, including an inclined chute that feeds paper to said shredder by the force of gravity and having sufficient length to delay the movement of the metal object along the chute for a time period sufficiently long as to prevent the metal object from damaging said shredder.

9. A device as defined in claim 8 in which said chute has substantial width, said detecting means extending laterally across substantially the entire width of said chute.

10. A device as defined in claim 8 in which said damage prevention means includes a gate for preventing passage of paper along said chute when said detecting means detects a metal object.

11. A device as defined in claim 8, comprising:

a motor for driving said shredder, said damage prevention means comprising means for deenergizing said motor when a metal object is detected by said detecting means.

12. A device as defined in claim 8 in which said damage prevention means includes means for stopping said shredder when said detecting means detects a metal object.

13. A device as defined in claim 8, including enclosure means for preventing placing of paper on said chute without such paper having passed said detecting means.

14. A device as defined in claim 8, comprising:

an electrically controlled brake for said shredder, said brake including means to hold the brake off when electricity is fed to said brake and for applying the brake when electricity is not fed to said brake, and means for stopping the supply of electricity to said brake when said detecting means detects a metal object.

15. A device for protecting a paper shredder from damage by a metal object that is associated with the paper, comprising:

detecting means for detecting metal objects, damage prevention means operable when said detecting means has detected a metal object for preventing said metal object from damaging a shredder, and enclosure means having an input opening for receiving the paper to be shredded, said detecting means being located adjacent said opening, said enclosure means comprising means for normally preventing paper to be fed to said shredder without passing through said opening, said damage prevention means including a gate for stopping the passage of paper to said shredder when a metal object is detected by said detecting means.

16. A device as defined in claim 15, including an inclined chute for feeding paper entering said opening to said shredder.

17. A device as defined in claim 15 in which said damage prevention means stops said motor when said detecting means detects a metal object.

18. A device as defined in claim 15, comprising:

a motor for driving said shredder, a brake for said shredder, said damage prevention means including means for applying said brake when said detecting means detects a metal object.

* * * * *